US007694487B1

(12) United States Patent
Ryan

(10) Patent No.: US 7,694,487 B1
(45) Date of Patent: Apr. 13, 2010

(54) SETTING A TUBULAR POST FOR AN ELECTRIC FIXTURE IN SOIL

(76) Inventor: Gary L. Ryan, 15 B06 Meadow Rd., Norwich, CT (US) 06360

( * ) Notice: Subject to any disclaimer, the term of this patent is extended or adjusted under 35 U.S.C. 154(b) by 0 days.

(21) Appl. No.: 12/215,892

(22) Filed: Jun. 30, 2008

Related U.S. Application Data

(63) Continuation of application No. 11/123,349, filed on May 6, 2005, now abandoned.

(60) Provisional application No. 60/569,227, filed on May 8, 2004.

(51) Int. Cl.
*E02D 27/42* (2006.01)
*E04H 17/22* (2006.01)

(52) U.S. Cl. ..... 52/741.15; 52/741.14; 52/297; 52/169.13; 52/154; 248/156

(58) Field of Classification Search ..... 52/127.2, 52/170, 741.11, 741.14, 741.15, 745.17, 52/745.18, 166, 154, 155, 165, 40, 169.13, 52/297, 298, 402; 248/530, 545, 156; 174/45 R
See application file for complete search history.

(56) References Cited

U.S. PATENT DOCUMENTS

| | | | | | |
|---|---|---|---|---|---|
| 612,052 | A * | 10/1898 | McMullen | ..... | 52/154 |
| 1,114,724 | A * | 10/1914 | Blackburn | ..... | 52/166 |
| 2,040,010 | A * | 5/1936 | McMahon | ..... | 52/127.2 |
| 2,315,516 | A * | 4/1943 | Gray | ..... | 256/1 |
| 3,563,502 | A * | 2/1971 | Dayson | ..... | 52/98 |
| 4,269,010 | A * | 5/1981 | Glass | ..... | 52/154 |
| D297,370 | S * | 8/1988 | Foster, Jr. | ..... | D25/133 |
| 5,156,454 | A * | 10/1992 | White | ..... | 362/153 |
| 5,504,397 | A * | 4/1996 | Chien | ..... | 315/185 S |
| 5,625,988 | A * | 5/1997 | Killick | ..... | 52/298 |
| 5,632,464 | A * | 5/1997 | Aberle | ..... | 248/530 |
| 6,240,689 | B1 * | 6/2001 | Haddad et al. | ..... | 52/298 |
| 6,336,620 | B1 * | 1/2002 | Belli | ..... | 248/519 |
| 6,742,314 | B2 * | 6/2004 | Young | ..... | 52/835 |
| 6,857,808 | B1 * | 2/2005 | Sugimoto et al. | ..... | 403/41 |
| 7,003,919 | B2 * | 2/2006 | Riker | ..... | 52/170 |
| 2002/0040957 | A1 * | 4/2002 | Carter | ..... | 248/530 |
| 2003/0115826 | A1 * | 6/2003 | Bobbitt | ..... | 52/726.4 |
| 2003/0145556 | A1 * | 8/2003 | Young | ..... | 52/736.1 |

* cited by examiner

*Primary Examiner*—Robert J Canfield
*Assistant Examiner*—Brent W Herring
(74) *Attorney, Agent, or Firm*—C. Nessler

(57) ABSTRACT

A tubular post for a light or other electrical device is mounted in soil with the use of an anchor which is comprised of a vertical sleeve and a flange which extends horizontally from the lower end of the sleeve. A flat bottom excavation is made in soil, to receive the anchor. Electrical conductors are run across the top of the flange, through ports in the sleeve and up the interior of the post. A stop within the bore of the sleeve limits downward movement of the post which is inserted into the top of the bore, to enable the running of the conductors through the ports. The excavation is then backfilled. When the anchor has been installed in soil so that top of the sleeve is near the surface, the post may be lifted from the sleeve and replaced without making a new excavation.

19 Claims, 6 Drawing Sheets

SETTING A TUBULAR POST FOR AN ELECTRIC FIXTURE IN SOIL

This application is a continuation of application Ser. No. 11/123,349, filed May 6, 2005, that is now abandoned. This application claims benefit of provisional patent application Ser. No. 60/569,227, filed May 8, 2004.

TECHNICAL FIELD

The present invention relates to devices for supporting the bases of posts, poles and other objects so they extend vertically from the surface of the earth.

BACKGROUND

Things, such as exterior lights, mail boxes, fences and other devices are often attached to free-standing vertical posts, poles or pipes which are sunk into the surface of the earth. A problem familiar to tradesmen and do-it-yourselfers is how to set such poles or posts in the soil, so they initially are vertical, and so they stay that way over time, without the use of braces or stays.

Part of the problem is that, as a post is being set, it may tend to deviate from the vertical when soil or other media is tamped into the excavation made for it. And, even when a post is set properly in place so it is plumb, the post may tilt with time, even in the absence of apparent tilting forces. When a post is only surrounded with soil, such tilting often can be attributed to the deformable nature of the soil in view of the size of the post, and a failure to set the post deep enough. Another less common failure, which it is nonetheless desirable to guard against, is that the post will rise up out of the ground over time, for instance due to alternate freezing and thawing of the soil, or that the post will sink with time.

Different approaches have been taken to deal with the situation. But, as often, the approaches which produce better results often require more time, skill or equipment. For instance, a post may be held vertically within an excavation by means of braces as the excavation filled with material. However, attaching braces to the post may not be easy if the post is metal or cannot accept marring. And, concrete, instead of soil, can be placed in the excavation around the post. However, that approach often requires the installer to return the next day to remove the braces and tidy up, after the concrete has cured. Furthermore, a post set in concrete is not easily relocated, as is the case with a post set only in soil. In another approach, a hole can be drilled in soil, with a diameter closely approximating the diameter of the post being set. However, that requires equipment suited for drilling, which can be heavy, costly, and difficult to position at the desired post location. And of course, the post must still be set deep enough in soil with suitable bearing strength. The approach is really only suited for round posts.

Inventions have been made, seeking to solve the problems in differing degrees. Some are of particular interest with respect to the present invention. U.S. Pat. No. 612,052 describes a cast iron foot-piece for attachment to the bottom of a post. The foot piece is a collared disk having upward projecting fins. U.S. Pat. No. 373,240 to Logan describes a post anchor which comprises a disc having vertical fins. The disc extends from a sleeve which is slidable along the length of a post, so one or more discs can be positioned where desired along the length of the post. U.S. Pat. No. 4,269,010 to Glass describes a similar device. U.S. Pat. No. 897,417 to Self describes an anchorage for a telegraph pole which comprises a flanged base with a conical top, in combination with a radial arm collar. More recently, for small plastic post-like devices, used for supporting low-lying garden lights or providing electrical outlets, an array of vertical fins have been attached to the devices, to increase the lateral bearing area of the post. See also, U.S. Pat. No. 5,984,587 to Odle and U.S. Pat. No. 3,727,357 to Stillman, Jr. for similarly functioning devices. Such fins extend outwardly and have the effect of increasing the projected vertical side area of the device, so as to resist tilting. In the prior inventions for posts, the means for securing the anchor to the post, such as screws, can deteriorate over time, potentially allowing movement of the anchor relative to the post. Conversely, since the anchors are buried the post cannot be released for storage or replacement unless an excavation is made.

There is a continuing need for a means for installing posts in the earth with a minimum expenditure of time. Furthermore, when a post is used for lighting purpose, it is common to run an electric wire underground at about 18 inch depth, from a source and up the hollow interior of a metal tubular post. So, any invention which seeks to solve the problems of easy and durable setting of posts should also accommodate the running of electric wires into the post.

SUMMARY

An object of the invention is to provide a means and method for setting a vertical post, pole or the like, in place within soil, and for maintaining the article in vertical position over the passage of time. A further object is to provide a base or anchor for a post which speeds and makes better the installation within soil, while at the same time providing for electrical conductors to run upwardly along or within the post. A further object of the invention is to permit convenient removal of a post from an anchor for replacement or repair.

In accord with the invention, an anchor for mounting a post in soil is comprised of a vertical sleeve, and an attached flange. The flange is near the bottom of the sleeve, preferably at the bottom, and projects radially outwardly, preferably perpendicularly, from the sleeve. A stop within the bore of the sleeve limits downward movement of a post which is inserted into the bore from above. In use, an anchor is installed on the flat surface of soil or fill within an excavation which has been made in soil, so the sleeve and any post to be held in the sleeve extends vertically from the soil surface when the excavation is filled. During use, the weight of soil on the substantially horizontal and flat surface of the flange keeps the anchor and the post in stable vertical condition, even in the presence of tilting forces. In an embodiment of the invention, the top of the sleeve is at or near the surface of a soil, so the post can be removed from the anchor and re-inserted if desired. Preferably the flange, which may be round, square, segmented, or of another shape, is at least 3 times, more preferably 5 times, the outside diameter of the sleeve, which is nominally the same as the diameter of the post.

In further accord with the invention, there are one or more ports for passage of electric conductors from the exterior to the interior of the sleeve. Preferably, there are opposing arch shape ports near the top surface of flange, so that the elbow end of an electric conduit can be conveniently inserted into the port to run across the flange. Alternately, one or more ports are higher than the elevation of the flange top. Still alternately, the conductors run under the flange and through a port at the bottom of the sleeve bore.

In further accord with the invention, when there are is a side port for electric lines, lines, the stop in the sleeve bore is at a higher elevation that the elevation of a port. The stop may have alternative embodiments, including: a continuous or segmented internal shoulder; or screws or the like, projecting into the interior of the bore; or one or more pins traversing the bore. Alternately, the stop is a feature at the bottom of the sleeve bore, like a continuation of the flange which projects inwardly into the bore, optionally to close off the bottom of the bore. These kinds of stops put the anchor positively near the bottom of the post and enable potential removal and re-insertion of the post after the anchor is buried, when the top of the sleeve is near the surface of the soil. Preferably one or more screws, or other adjusting or fastening means, are located at the top of the sleeve, so the post may be fastened in place, or when there is sufficient clearance between the post and bore of the sleeve, for slightly adjusting the angle of the post relative to the anchor.

In a further embodiment of the invention, a garden post comprises a small dimension column that is mostly buried within soil to support an electric device just above the surface of the soil. The post has a flange in proximity to the bottom of the column. The flange extends laterally and has dimensions and relationships, and features, including ports for electric conductors, similar to those referred to above.

The foregoing and other objects, features and advantages of the present invention will become more apparent from the following description of preferred embodiments and accompanying drawings.

DESCRIPTION

The invention is principally described in terms of a hollow cylindrical tubular post, such as used for a light fixture which is mounted about 6 feet off the surface of soil. In this description and the claimed invention, the term post is intended to comprehend a pole or any other vertical structural element, whatever the exterior shape, and whether solid or hollow, which has a function when set in soil so it projects above the surface of the soil.

Figure 1:
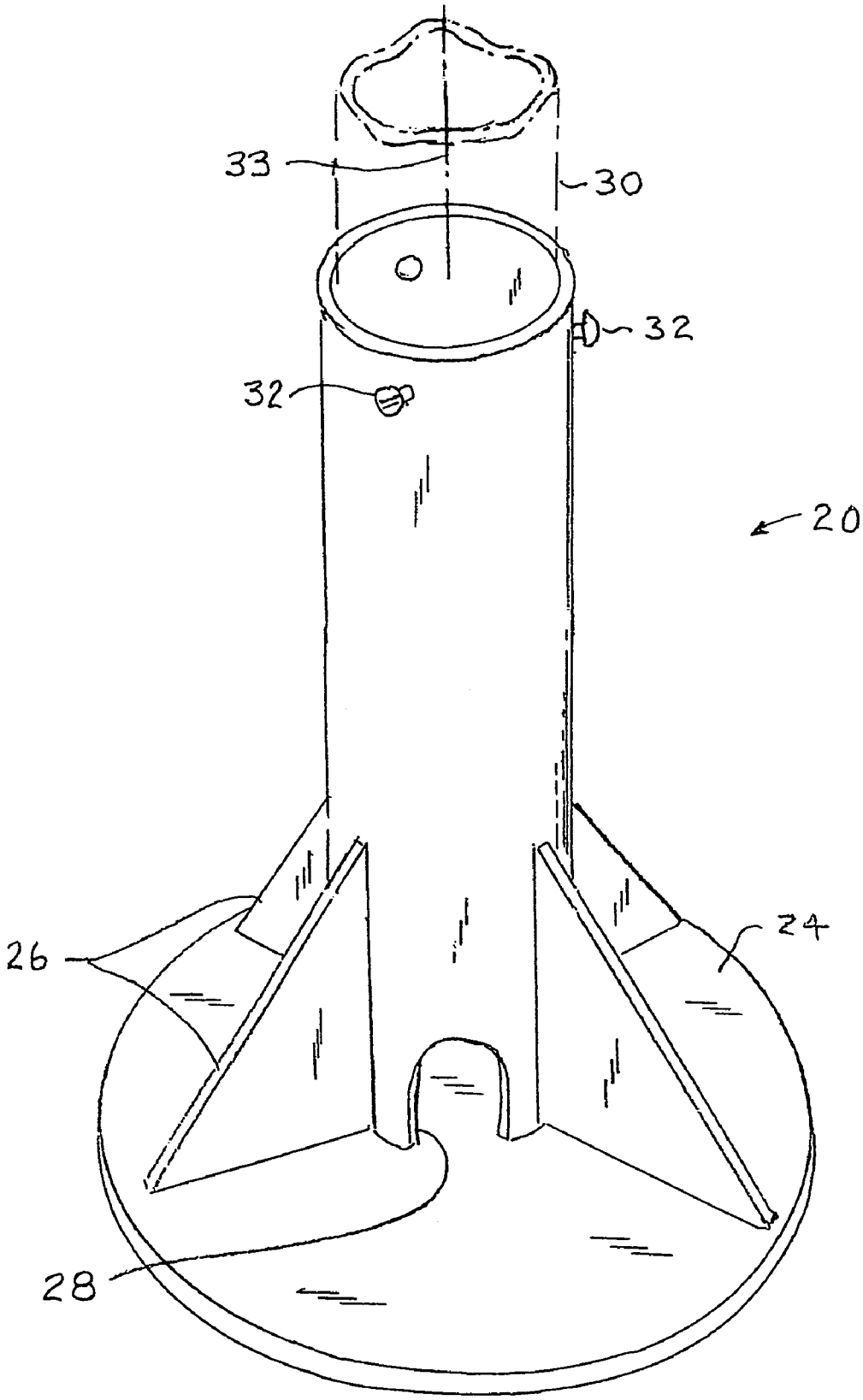
FIG. 1 is a quasi-isometric view of an anchor.
Figure 2:
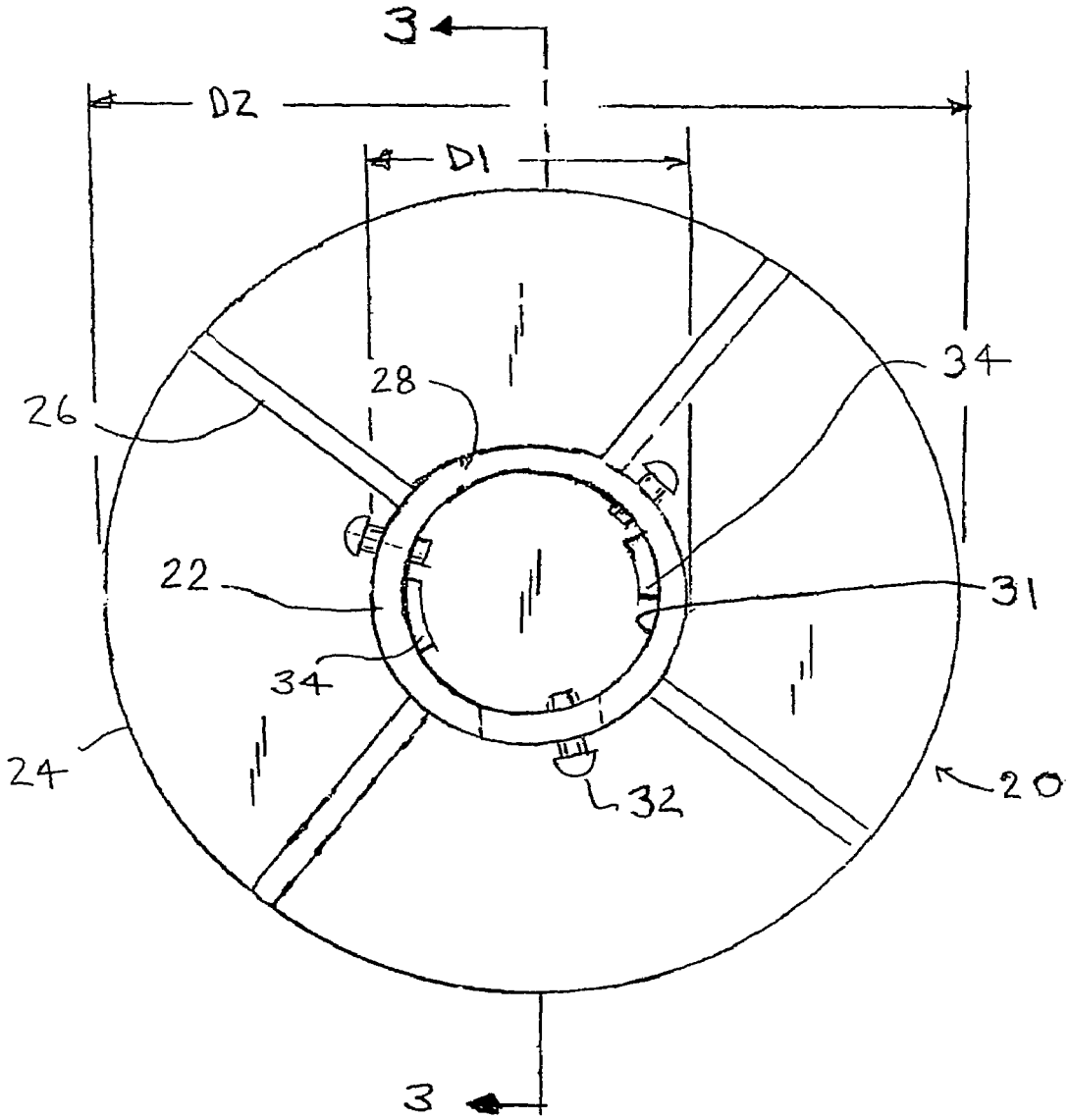
FIG. 2 is a top view of the anchor shown in FIG. 1.

FIG. 1 is a perspective view and FIG. 2 is a top view of anchor 20 which is comprised of a tubular body, or sleeve 22 and a flange 24 at the bottom of the sleeve, which flange extends radially outward. The anchor is preferably constructed of molded plastic, such as high density polyethylene or polypropylene, but may be constructed of other plastic or metal materials. Four braces 26, in the form of flat plates are welded to flange 24 and sleeve. A hollow tubular post 30, such as 3 inch aluminum tubing, is shown in phantom, as it slip-fits within the interior cavity, or bore 31, of sleeve 22. It is optionally held in place by one or more clamping screws 32. If by design the fit between the post and bore of the sleeve 22 allows it, screws 32 or substitutional means may be used to make fine adjustment to the tilt of the post within the anchor.

Figure 7:
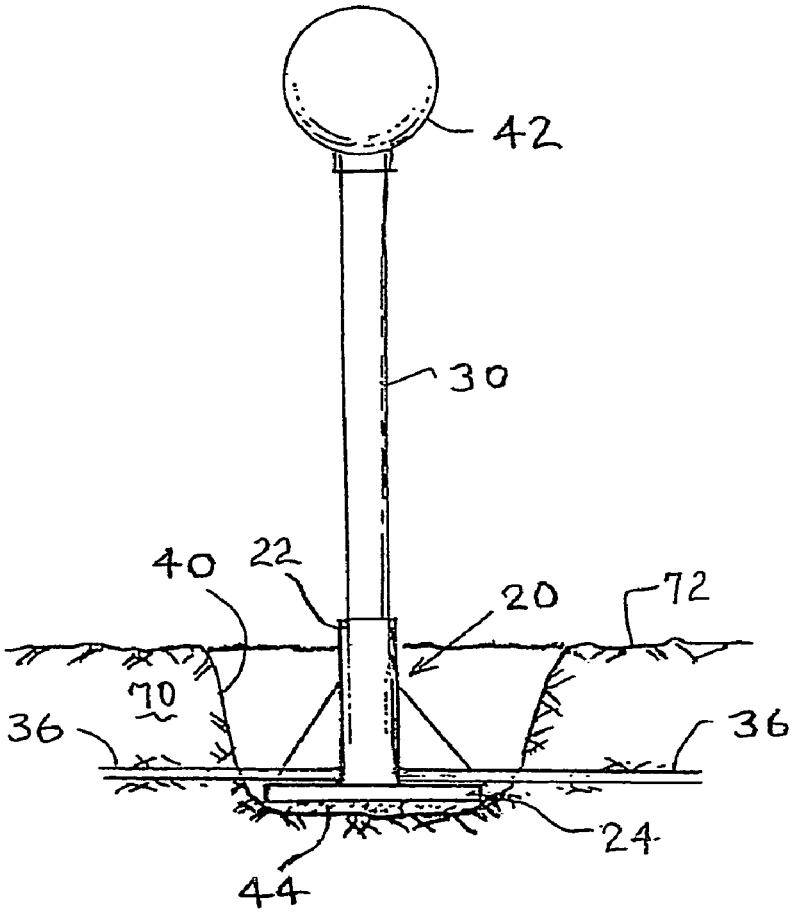
FIG. 7 is a vertical elevation view of an anchor like that shown in FIG. 1, supporting a light-bearing post, contained within an excavation in soil.

FIG. 7 shows how anchor 20 is used to support a post 30 bearing light fixture 42. An excavation 40 is made in soil 70, with a dimension sufficient to allow the flange 42 lie horizontally on the hole bottom. The bottom of the excavation is leveled, to provide a surface which is substantially level; it may be uneven with peaks and valleys. The installer then puts the anchor into the excavation and presses down on the flat top surface of the flange with his foot, or by hand or with a tool, to make the flange settle nicely in the bottom of the excavation. As needed, small amounts of soil or fill 44 are added or removed from the underside of the flange by lifting the anchor and replacing it, so the flange is horizontal and the sleeve is vertical. Typically a measuring device such as a plumb bob, bubble level or laser level is used to make the sleeve vertical. Electric conductor lines 36, previously run to vicinity of the excavation by means of a trench, are then passed through ports 28, as described further below. The post may be placed in the sleeve prior to the placement of the anchor in the excavation; or it may be put in place within the sleeve after leveling and before backfilling. Typically, the top of the sleeve is at or just below the surface of the soil after backfilling. When the sleeve is at the surface of the filled excavation, the post may be put in place after backfilling. When the excavation is back filled, the soil surface 72 runs up to the post or top of the sleeve. Thereafter, when a tilting force is applied to the post, the force is resisted by the weight of the backfilled soil resting on the top of the flange in combination with the bearing of the bottom of the flange on the underlying soil. And, the large horizontal surface areas of the flange on the soil will inhibit any up or down motion of the anchor and thus of the post. The low weight of the anchor and the large bearing of the flange help make the anchor stable even when the soil beneath has not been well compacted.

Figure 9:
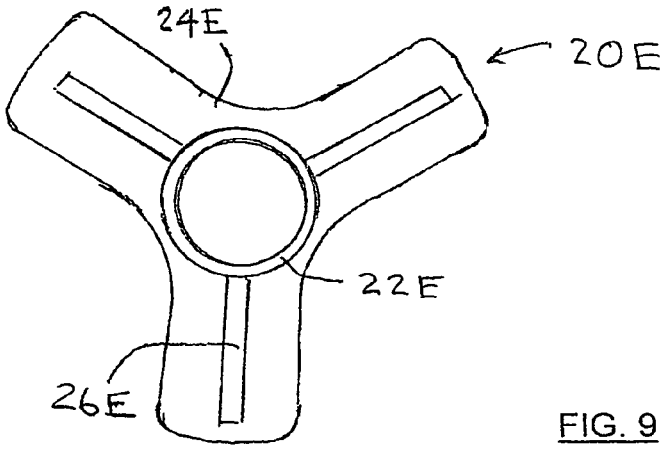
FIG. 9 is a top view of an anchor having a segmented flange.
Figure 10:
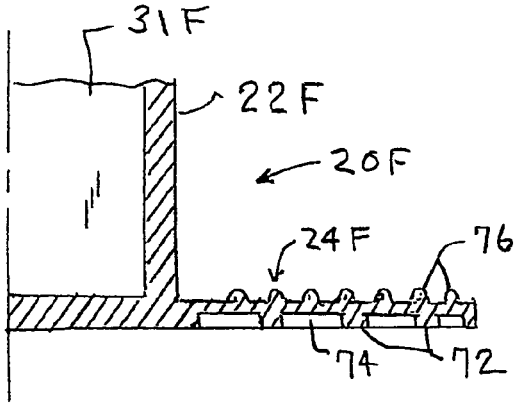
FIG. 10 is a half-vertical cross section of an anchor, showing an embodiment of flange construction and a stop at the bottom the sleeve.

Flange 24 has planar upper and bottom surfaces, both running radially, to the longitudinal axis of sleeve 22. As shown in FIG. 1, the flange is preferably perpendicular to the longitudinal axis 33 of the sleeve, but may vary somewhat from such within the meaning of extending radially from the sleeve. Preferably, the flange has two smooth opposing continuous surfaces, also as shown in FIG. 1. Alternately, for economy of production the flange may have lightening holes. It may also have "egg-crating", that is ribs 72 with blind pockets 74, as shown for anchor 20F in FIG. 10, or waffling or other known features for providing stiffness to sheets. (Wherever suffixes are used with numbers for the Figures herein, they denote features analogous to those with the plain number. For ease of reading they are not repetitively called out. This applies to the following elements: 31C, 31D, 31F (bores); 22A, 22C, 22D (sleeves); 26A, 26G, 28G (ports).) As shown in FIG. 10, the upper surface of flange need not be smooth, but may have circumferential ribs 76 or the like. A flange upper surface, which is substantially horizontal, enables the maximum amount of back fill to lie on the flange and hold the anchor in place during use; and the configuration aids an installer in tamping the anchor in place. Looking down, the periphery of the flange may be round as shown in FIG. 2, or it may be rectangular like flange 24A of anchor 20A in FIG. 5, or it may be of some other shape. The flange may alternately be segmented, as is flange 24E of anchor 20E in FIG. 9.

The lateral dimension of the flange is substantially greater than the external dimension (i.e., external width) of the sleeve. By that is meant that the flange diameter is at least twice the diameter of the sleeve, which for relationship purposes herein is substantially the same as the diameter of the post 30 which is receivable in the sleeve of anchor 20. When the flange or post are not round, the term diameter as used herein shall be construed as applying to the diameter of a circle which has nominally the same cross sectional area as the area of the non-round post or flange. In an example of the invention, where the ratio of flange outside diameter is about 5 times the outside diameter of the sleeve or post, a round sleeve has an internal bore of about 3 inches, an outside diameter of about 3.5 inches, and a total height of about 18 inches. The flange outside diameter is about 17 inches. In the example, the braces are approximately shaped as isosceles triangles having a side dimension of 7.5 to 8 inches.

In the invention, the outside diameter of the flange is preferably at least three times greater than, more preferably about 5 times greater than, the nominal outside diameter of the tube. The corresponding area ratios of sleeve outside diameter and flange outside diameter are: preferably at least 9:1, more preferably about 25:1. As the example above shows, the length of the sleeve is great compared to the diameter of the post, to provide good sideways bearing area for post and to distribute the load along a sleeve. In the invention, the sleeve length is at least about 3 times, preferably about 5 times or more, the diameter of the bore. Preferably, it is about 18 inches in length, since that is the conventional depth at which electric conductors are buried. Thus, the top of the sleeve can be at the surface of the soil when desired, so any screw(s) 32 or the like can be conveniently released and the post can be slid out of the sleeve, as described further below. The bore is shaped so a post can be slid or slipped into the bore downwardly, from the top of the sleeve, and is preferably constant diameter above the stop location.

Figure 3:
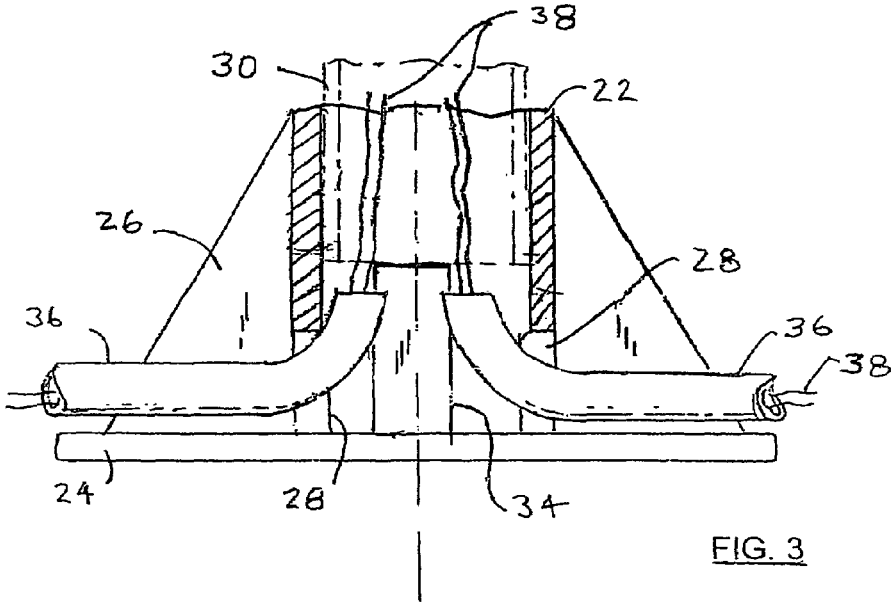
FIG. 3 is a partial vertical cross section view of the anchor of FIG. 1, showing how electric conduits run through ports near the base flange.

Referring again to FIGS. 1 and 2, arch shape ports 28 at the base of sleeve 22 enable an electric conductor to be run into and up the interior of a hollow post set within the anchor. Preferably, there are two opposing ports 22, as shown, but more, or only one, may be present. Preferably, the port is an arch shape opening located near the bottom of the sleeve, and at the top surface of the plate. When the port is at such location, and when it is arch shape, it is easy to cant and slip the elbow end 36 of a PVC conduit into the port. In the exemplary article described just above, the arch shape ports may be about 1.8 inches wide by about 1.8 inches high, so they are suited for insertion of the elbow end of a common PVC conduit of nominal one half inch diameter, by sliding the end of such along the plate surface. FIG. 3 shows the elbow shape ends 36 of two conduits carrying electric conductors 38, after they have been slipped through ports 28. Thus, when installed, the conduits and conductors therein run across the plate top surface and up the bore of the sleeve and into the interior of a tubular post, to an electric device on the post. Alternately, a direct burial UF type electric conductor may be used without conduit, and may be run in the same way.

FIGS. 2 and 3 show stop in the form of to opposing side shoulder-segments 34, having top surfaces which are above the elevation of the top of the ports 28. The tops of shoulder segments 34 support the bottom of post 30 when it is inserted into the bore of sleeve 22, to keep the post bottom from blocking the ports 28 and from contacting the conduits or wires which run through ports. Alternately, stop 34 may be a shoulder which is continuous around the bore, e.g., a ring around the bore just above the tops of the ports (as illustrated in FIG. 4B, but without the steps).

In the present invention embodiments, there is a stop within the sleeve; that is, a means for positively limiting downward motion of the post within the sleeve; and other embodiments may be used. The means may permanent, or may be removable to permit the post to sit lower within the anchor for more lengthwise support, when there are ports but there is to be no wire. In an alternate embodiment, stop 34 comprises pins or screws penetrating through the wall of the sleeve, as do screws 32 if they are fully extended without a post in place. In another embodiment, the stop is pin 34C which traverses the bore of the sleeve, as shown for anchor 20C in FIG. 4A. In another embodiment, the stop is comprised of a series of concentric steps 34D which have outwardly tapered risers, as illustrated for anchor 20D in FIG. 4B. The stop 34D may be constructed in accord with the teachings of the aforementioned Aberle U.S. Pat. No. 5,632,464, particularly as shown in FIG. 2A. Thus, if a post having a substantially smaller diameter than the diameter of the sleeve bore is inserted in the sleeve it is centralized. The disclosure of said patent is hereby incorporated by reference. At the upper end of the sleeve, the features described by Aberle may be used; alternately, sufficiently long screws 32 may be used.

Another stop embodiment comprises structure which partially or fully closes off the bottom the sleeve bore, e.g., an extension of the flange. For all anchors with stops, the anchor necessarily is proximate the bottom of the post and cannot be positioned along the post as is the case with the prior art anchors mentioned in the Background. But, there is a benefit to such. When installed in soil, the invention anchor prevents downward motion of the post in a positive way by engagement with the plain butt end of the post, compared to prior art means, where frictional or pin means for holding an anchor on a post are used. Furthermore, as mentioned, the invention makes it feasible to remove the post from the sleeve after the anchor has been buried; which is not feasible for anchors which are secured to the bottom of a post by fasteners.

Figure 4A:
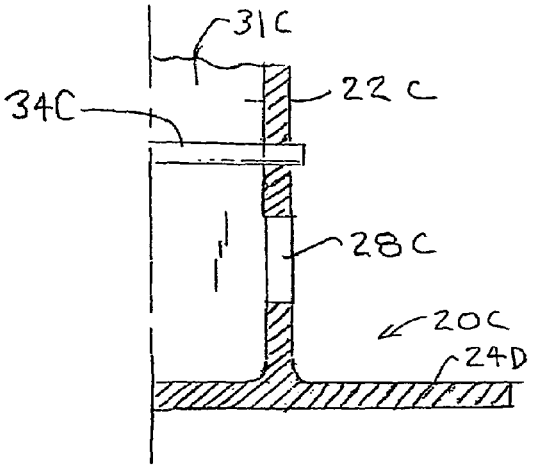
FIG. 4A and FIG. 4B are half-vertical cross sections of alternate embodiment anchors like that of FIG. 1, to illustrate internal stop and port features.
Figure 4B:
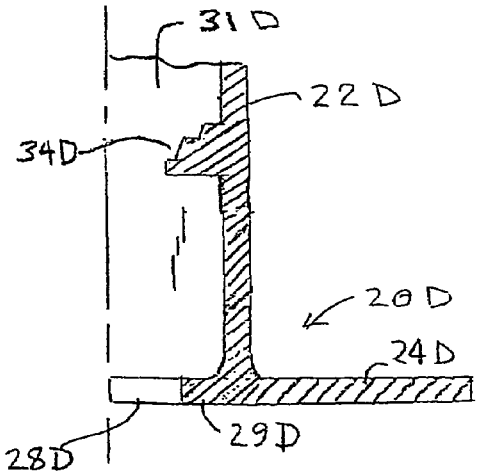

FIG. 4A and FIG. 4B show alternate embodiments for the electric conductor ports. In FIG. 4A, the port 28C of anchor 20C is round or some another shape, and is at an elevation above the flange. Sometimes, commercial tubular light posts are provided with openings at an elevation away from the bottom of the post, to enable running a wire from the outside to the interior of the post. For such uses, the port 28C of anchor 20C may be put at an elevation which matches the elevation of a hole in the post, and no stop above the flange level will be necessary. FIG. 4B shows an anchor 20D having a port 28D which is formed by the inward extension 29D of flange 24D across the bottom of the bore of the sleeve. See also FIG. 10 where the extension of the flange closes off the bottom. Where ports have been described, the anchor may be alternately provided with heavily embossed or partially cut out portions, to provide familiar "knock-outs," which the installer can selectively remove in the field. Within the meaning of the claims, such knock-outs are equivalent to the ports which are producible by their removal.

Figure 5:
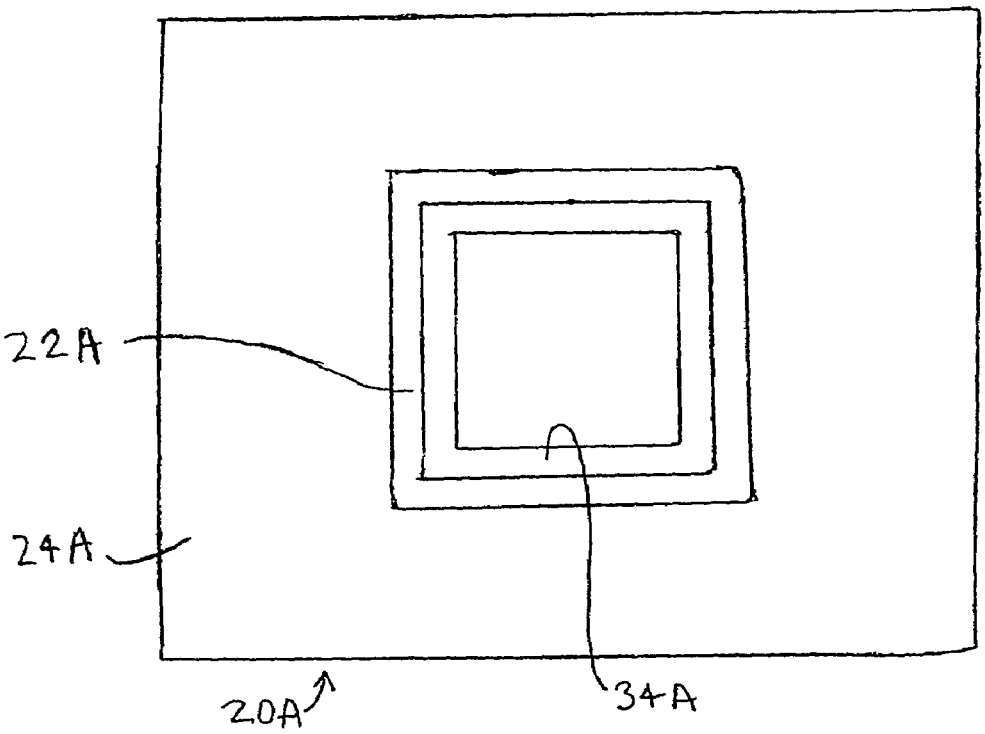
FIG. 5 is a top view of an anchor having a rectangular flange and a square cross section sleeve.
Figure 6:
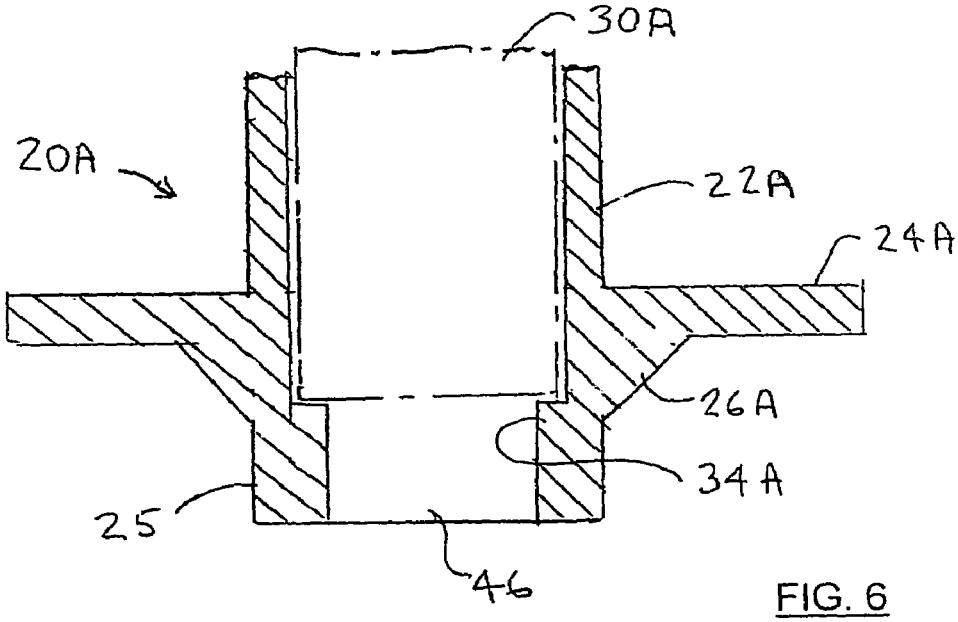
FIG. 6 is a vertical cross section view of the anchor of FIG. 5.

The FIG. 5 top view and the FIG. 6 elevation cross section view show anchor 20A which is adapted to receive a square post. This embodiment is used to show several alternative features which may be used individually with other embodiments. First, the periphery of flange 24A is rectangular. Second, sleeve 22A has a rectangular cross section bore, in a square, to receive a like shaped solid post 30A, shown in phantom, or a like hollow post. For instance, post 30A could be wood post for a mail box. Third, flange 24A is proximate the bottom of the sleeve, but not at the bottom of the sleeve. Fourth, the stop 34A is located so that the bottom of the post rests on a stop positioned below the elevation of the flange. Fifth, there is an opening through the bottom of the flange, which will provide drainage through passageway 46 for any water which may work its way into the sleeve from above, even if no electric wires are contemplated. Sixth, the bracing 24A is a continuous heavy fillet or cone of material around the underside of the flange with runs to the downward extending portion 25 of the sleeve.

For all embodiments, bracing between the flange and sleeve exterior may be omitted if the connection between the sleeve and flange is strong enough. With reference to FIGS. 1, 2 and 9, the bracing is preferably above the plate and comprises flat members, as shown in FIG. 1. Having four equally spaced flat braces provides in increase vertical plane surface area, to further resist tiling to the anchor in the soil. The number and spacing of braces may be varied. The size, shape and number of braces should not be such as to negate the above-described usefulness of a substantially flat upper surface of the flange.

Figure 11:
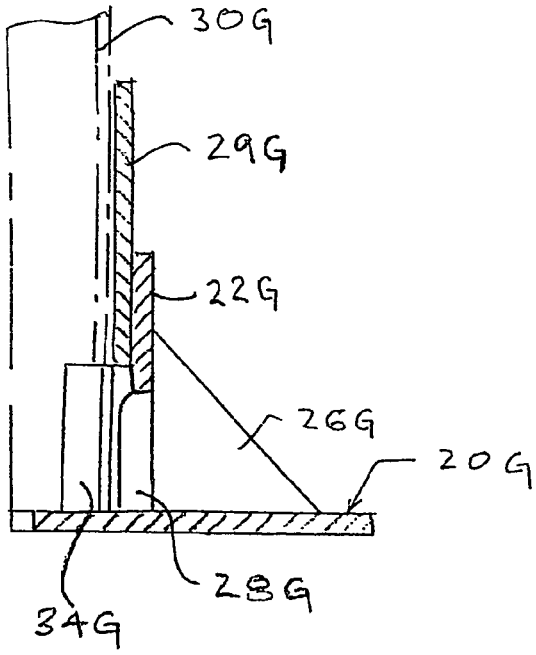
FIG. 11 is a half-vertical cross section of an anchor having a two-piece sleeve.

The sleeve may comprise an assembly of two of more sections to enable economical shipment. As shown in FIG. 11, anchor 20G has a lower sleeve portion 22G and an upper sleeve portion 29G, which slips into the bore of portion 22G. Post 30G, in phantom, slides into the bore of portion 30G when the anchor is in use. Stop 34G is like those described for FIGS. 1 and 2. The stop extends radially into the bore a sufficient distance, so that both the post and upper sleeve portion rest on its top surface. Other than for upper part of the sleeve, the anchor is one-piece, as preferably are the other embodiments described above. Having an integral stop within the sleeve, and an integral flange and sleeve, in combination, is important with respect to maintaining over time the elevation of a post relative to the original placement of the flange.

A feature of the invention is that, when the sleeve extends to or above the surface of the soil, the post may optionally be temporarily removed from the anchor by releasing the holding screws 32 if they are used. The post can be later replaced or re-inserted. Any electric conductors can be disconnected and reattached by means of normally releasable connections e.g. wire nut connections, or quick-disconnect fittings. Another feature of the invention is that, if it should be desirable to remove any anchor to a different location, the anchor can be dug up and moved, owing to its light weight and durability.

Figure 8:
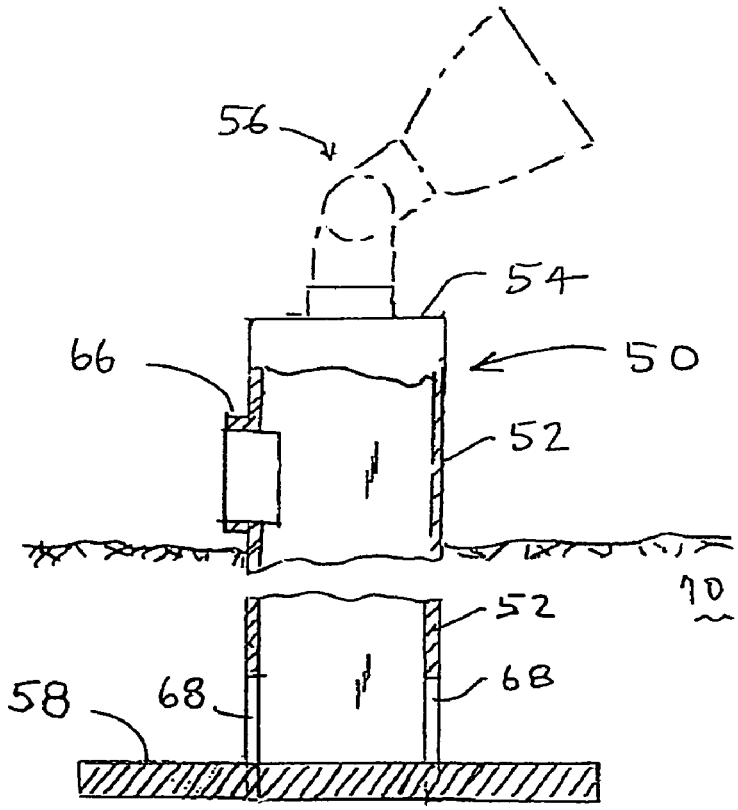
FIG. 8 is a partial elevation view cross section of a garden post having a bottom flange.

FIG. 8 shows another embodiment of the invention, namely a garden post 50. A garden post is used for supporting a small electric device just above the surface of soil, such as a lawn light or an electric power outlet. For example, a post is about 3 inch square and about 20 inches long. Garden post 50 of the present invention, preferably made of molded plastic, comprises vertical column 52, at the bottom of which is attached horizontal flange 58. The top 54 of post 50 is adapted to receive an electric fitting or device, such as light 56 shown in phantom. The column 52 has an opening 66, which is adapted to receive a device, such as a duplex electric outlet. Often only one such feature may be present; or the post may have other features for holding something else. The periphery of flange 58 may be square, round, or otherwise. An exemplary square flange will preferably have an about 12 inch square flange. The proportional relationships for the flange to the column are comparable to the dimensions of the sleeve as described above. The flange is also preferably flat. Given the smaller dimension, substantial braces might be omitted, or they may be used. In FIG. 8, garden post 50 is shown installed and ready for use, having been placed within the soil in the same way as described in connection with FIG. 7. Electric lines are not shown but may be run through opposing side ports 68. Alternately, there may be instead, or in addition, a downward facing port, through the flange which closes the bottom of the cavity, to connect the body interior to the soil underneath. Port configurations and location variations which have been described above for the anchor may be used. In another embodiment, flange 58 may be configured with an integral boss, so it slip fits onto the bottom of a prior art garden post, to be held in place because of in internal stop, alternately by screws or other fasteners as in the prior art.

Although this invention has been shown and described with respect to some embodiments, it will be understood by those skilled in this art that various changes in form and detail thereof may be made without departing from the spirit and scope of the claimed invention.

I claim:

1. The method of installing a post in soil so the post extends upwardly from the soil surface which comprises:

(a) removing soil to provide an excavation having a substantially horizontal bottom;

(b) setting an anchor within said excavation upon said substantially horizontal bottom, wherein the anchor comprises:

a flange extending horizontally, for resting on said substantially horizontal bottom of the excavation, to support the anchor; and, a vertically extending sleeve, attached to the flange, having a bore adapted for slidably receiving a tubular post from above; the sleeve having at least one port in the side thereof at an elevation which is equal or higher than the elevation of the top surface of said horizontally extending flange where it attaches to the sleeve;

a stop within said bore, for limiting the downward motion of the lower end of a post which is slidably inserted into the sleeve from above, to prevent the bottom of the slidably-received post from blocking said at least one port;

(c) leveling the anchor to the extent needed, to make the sleeve vertical;

(d) slidably inserting a tubular post downwardly into the bore of the sleeve, so the post contacts the stop; the post having a lengthwise interior for running of electrical conductors;

(e) running at least one electrical conduit or conductor within the excavation and through said at least one port and into the bore of the sleeve, so that the electrical conduit or conductor runs generally horizontally on or above the upper surface of said flange and vertically upward through the interior of said sleeve; and, (f) backfilling the excavation with soil or other material to cover the flange, so the top of the sleeve is near to or above the surface of the soil, and so, when said tubular post is inserted into the sleeve, said tubular post extends vertically upwardly from the surface of the soil;

wherein, during use of said post, the flange of the anchor inhibits tilting or vertical movement of the post by engagement with soil.

2. The method of claim 1 wherein step (d) is done after step (e) or step (f).

3. The method of claim 1 which further comprises: mounting an electrical fixture on the upper end of the post; running said conductor through the interior of the tubular post; and connecting the conductor to the electrical fixture.

4. The method of claim 1 which further comprises: subsequently removing the post from the sleeve by sliding the post vertically up and out of the sleeve; and slidably inserting a new post in the sleeve in replacement of the first post.

5. The method of claim 1 wherein said sleeve of the anchor has at least a second port; wherein said second port is located on the opposing side of the sleeve from the first port; and, wherein the method further comprises: running electrical conduits or conductors through both of said ports so the conduits or conductors run generally horizontally on or above the upper surface of said flange and vertically upward within the interior of said tubular post.

6. The method of claim 1 wherein said at least one port of the sleeve of the anchor is an arch shape opening, the base of which arch opening is at the elevation of the top surface of the flange.

7. The method of claim 1 wherein said stop is selected from the group which comprises: a continuous shoulder within the bore of sleeve, a segmented shoulder within the bore of the sleeve, one or more pins projecting into the bore of the sleeve, one or more members traversing the bore of the sleeve, and a multiplicity of stepped shoulders within the bore of the sleeve.

8. The method of claim 1, wherein the anchor further comprises a multiplicity of fasteners near the top of the sleeve, for securing a post within sleeve bore, and for adjusting the angle of a post slidably received within the bore of the sleeve; and, wherein the method further comprises, tightening said fasteners to adjust the angle of the post within the bore of the sleeve or to inhibit slidable removal of the post from the bore.

9. The method of claim 1 wherein the sleeve of the anchor has a circular cross section bore and the post has a circular cross section.

10. The method of claim 1 wherein the anchor further comprises: a continuation of the sleeve extending downwardly from the lower surface of the flange.

11. The method of claim 1, wherein said the anchor further comprises: a vertically downward passageway which is smaller in dimensions than the bore of the sleeve, connecting the sleeve bore with the soil which lies below the flange.

12. The method of claim 1 wherein the flange of the anchor has a substantially planar top surface.

13. The method of claim 1 wherein the flange of the anchor is radially segmented.

14. The method of claim 1 wherein said anchor further comprises: a multiplicity of flat plate braces running from the top surface of the flange to the exterior of the sleeve, where said at least one port is located between two of the braces where they meet the exterior of the sleeve.

15. The method of claim 1 wherein the anchor has a flange which has a horizontal dimension which is at least 3 times greater than the diameter of the sleeve.

16. The method of claim 15 wherein the sleeve has a length which is at least 3 times longer than the diameter of the bore of the sleeve.

17. The method of claim 15 wherein said flange has a horizontal dimension which is at least 5 times greater than the diameter of the sleeve.

18. The method of claim 1 wherein step (c) is done simultaneously with step (f).

19. The method claim 1 wherein said anchor is made of plastic material.

* * * * *